US007837523B2

(12) United States Patent
Makita

(10) Patent No.: US 7,837,523 B2
(45) Date of Patent: Nov. 23, 2010

(54) WATER-JET PUMP, IMPELLER FOR THE SAME, AND BOAT INCLUDING THE SAME

(75) Inventor: Hiroyuki Makita, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 189 days.

(21) Appl. No.: 12/209,614

(22) Filed: Sep. 12, 2008

(65) Prior Publication Data

US 2009/0117790 A1 May 7, 2009

(30) Foreign Application Priority Data

Nov. 1, 2007 (JP) ..... 2007-284746

(51) Int. Cl.
*B63H 11/00* (2006.01)

(52) U.S. Cl. ..... 440/38; 416/223 R; 417/151

(58) Field of Classification Search ..... 416/223 R; 417/151; 440/38

See application file for complete search history.

(56) References Cited

U.S. PATENT DOCUMENTS 6,699,016 B1 * 3/2004 Dean ..... 416/235

FOREIGN PATENT DOCUMENTS

JP 9-99895 4/1997

* cited by examiner

*Primary Examiner*—Stephen Avila
(74) *Attorney, Agent, or Firm*—Ditthavong Mori & Steiner, P.C.

(57) ABSTRACT

A water-jet pump includes a cylindrical housing and an impeller. The impeller is disposed in the cylindrical housing and is configured to be rotated in a rotating direction. The impeller includes a shaft body and plural blades. The plural blades are provided on an outer circumference of the shaft body. A front portion of one of the plural blades overlaps a rear portion of another of the plural blades adjacent to one of the plural blades when viewed in an axial direction of the shaft body. When viewed in the axial direction, at least a part of a rear edge of the rear portion is formed obliquely with respect to a radial direction of the impeller towards the rotating direction. A cutaway portion is formed in each of the plural blades between at least a part of the rear edge and the outer circumference.

20 Claims, 9 Drawing Sheets

BACKGROUND ART

WATER-JET PUMP, IMPELLER FOR THE SAME, AND BOAT INCLUDING THE SAME

CROSS-REFERENCE TO RELATED APPLICATIONS

The present application claims priority under 35 U.S.C. §119 to Japanese Patent Application No. 2007-284746, filed Nov. 1, 2007. The contents of this application are incorporated herein by reference in their entirety.

BACKGROUND OF THE INVENTION

1. Field of the Invention

The present invention relates to a water-jet pump (hereafter, also referred to simply as a jet pump), an impeller for the water-jet pump, and a boat including the water-jet pump.

2. Discussion of the Background

FIGS. 9A and 9B show a conventional-type jet pump. This known-type water-jet pump is provided with an impeller 3 installed in a cylindrical housing. The impeller 3, which is driven to revolve, includes a shaft body 1 and plural blades 2 that are formed on the outer circumference of the shaft body 1. In the impeller 3, a front portion 2*f* of each one of the blades 2 overlaps a rear portion 2*r* of the adjacent one of the blades 2, when viewed in the axial direction of the impeller 3. See, for example, FIGS. 3 to 5 of Japanese Patent Application Publication No. H9-99895. The contents of Japanese Patent Application Publication No. H9-99895 are incorporated herein by reference in their entirety.

In a jet pump of this kind, a water jet is produced by driving the impeller 3 to revolve, propelling the boat.

The impeller 3 shown in FIGS. 9A and 9B has a configuration to improve its pumping efficiency. Specifically, each of the blades 2 is formed so long in the rotating direction of the impeller 3 that the front portion 2*f* of each one of the blades 2 overlaps the rear portion 2*r* of the adjacent one of the blades 2 when viewed in the axial direction of the impeller 3. A region thus formed by the overlapping is referred to as an overlap region OL.

In the conventional jet pump shown in FIG. 9A, rear edges 2*e* of the blades 2 are formed extending in straight lines with respect to the respective radial directions towards a shaft center O when viewed in the axial direction of the impeller 3.

Now, suppose a case where an either stopped or slowly-travelling boat starts to advance at full speed and another case where a boat goes circling. In these cases, the pressure at the forward side of the impeller 3 decreases while the impeller 3 revolves a high speed. Here, the above-described blades 2 of the impeller 3 brings about a problem of vibrations of impeller 3 caused by the cavitation. The vibrations of the impeller 3 are transmitted by the jet pump, and generate vibrations of the boat body and annoying sounds.

To be more specific, in each overlap region OL formed by the front portion 2*f* of each one of the blades 2 and the rear portion 2*r* of the adjacent one of the blades 2, a high-pressure region in the front portion 2*f* of that one of the blades 2 interferes with a low-pressure region in the rear portion 2*r* of the adjacent one of the blades 2. The interference causes an abrupt pressure fluctuation, and the water flow is disturbed to a great degree. Accordingly, vibrations and annoying sounds are generated, and are then passed on to the boat body via the impeller 3 and the jet pump.

SUMMARY OF THE INVENTION

According to one aspect of the present invention, a water-jet pump includes a cylindrical housing and an impeller. The impeller is disposed in the cylindrical housing and is configured to be rotated in a rotating direction. The impeller includes a shaft body and plural blades. The shaft body has an outer circumference and an axial direction. The plural blades are provided on the outer circumference of the shaft body. Each of the plural blades has a front portion and a rear portion along the axial direction. The front portion of one of the plural blades overlaps the rear portion of another of the plural blades adjacent to one of the plural blades when viewed in the axial direction. When viewed in the axial direction, at least a part of a rear edge of the rear portion is formed obliquely with respect to a radial direction of the impeller towards the rotating direction. A cutaway portion is formed in each of the plural blades between said at least a part of the rear edge and the outer circumference of the shaft body.

According to another aspect of the present invention, an impeller for a water-jet pump configured to be rotated in a rotating direction includes a shaft body and plural blades. The shaft body has an outer circumference and an axial direction. The plural blades are provided on the outer circumference of the shaft body. Each of the plural blades has a front portion and a rear portion along the axial direction. The front portion of one of the plural blades overlaps the rear portion of another of the plural blades adjacent to one of the plural blades when viewed in the axial direction. When viewed in the axial direction, at least a part of a rear edge of the rear portion is formed obliquely with respect to a radial direction of the impeller towards the rotating direction. A cutaway portion is formed in each of the plural blades between said at least a part of the rear edge and the outer circumference of the shaft body.

According to further aspect of the present invention, a boat includes a water-jet pump which includes a cylindrical housing and an impeller. The impeller is disposed in the cylindrical housing and is configured to be rotated in a rotating direction. The impeller includes a shaft body and plural blades. The shaft body has an outer circumference and an axial direction. The plural blades are provided on the outer circumference of the shaft body. Each of the plural blades has a front portion and a rear portion along the axial direction. The front portion of one of the plural blades overlaps the rear portion of another of the plural blades adjacent to one of the plural blades when viewed in the axial direction. When viewed in the axial direction, at least a part of a rear edge of the rear portion is formed obliquely with respect to a radial direction of the impeller towards the rotating direction. A cutaway portion is formed in each of the plural blades between said at least a part of the rear edge and the outer circumference of the shaft body.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
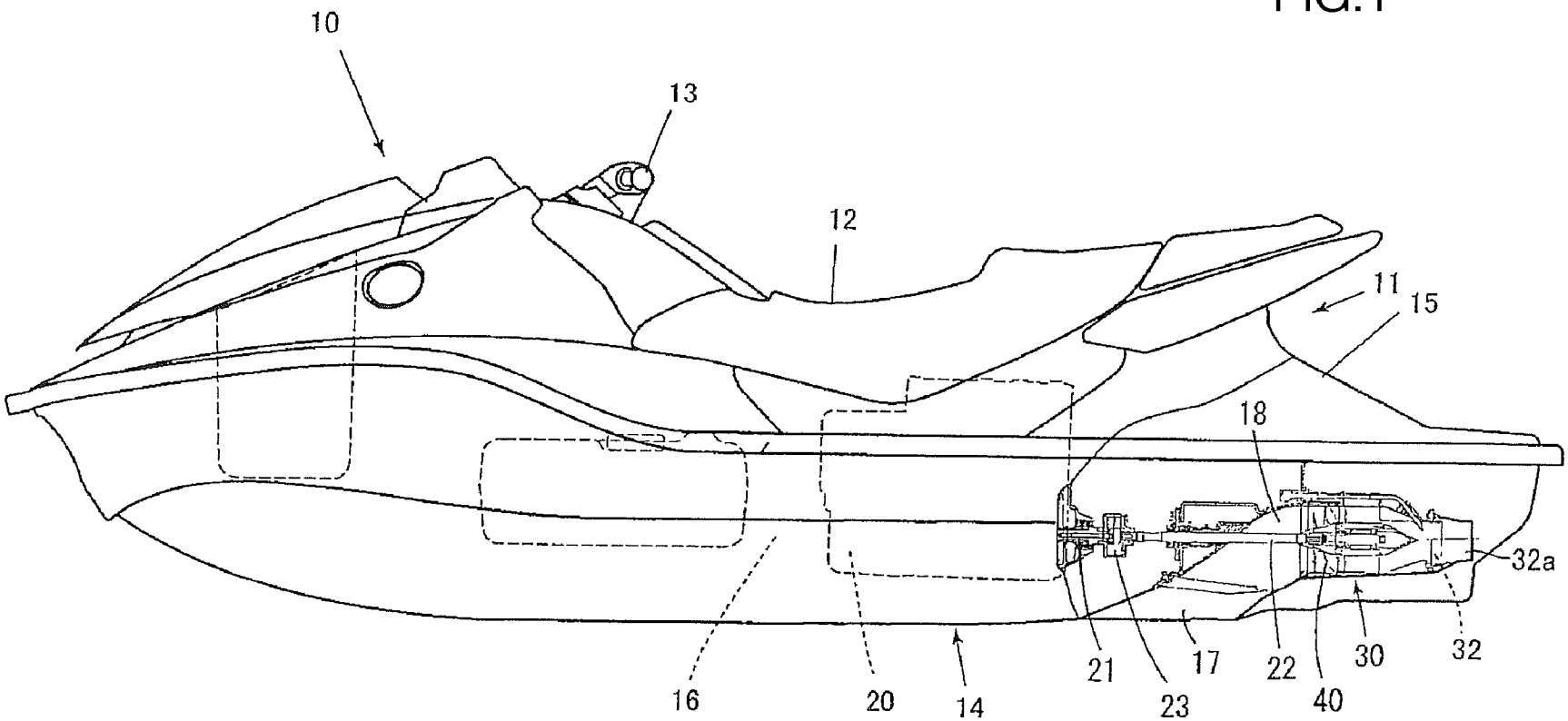
FIG. 1 is a partly cut-away schematic side view of an exemplar personal watercraft that employs a water-jet pump according to an embodiment of the present invention.

The embodiments will now be described with reference to the accompanying drawings, wherein like reference numerals designate corresponding or identical elements throughout the various drawings.

Figure 2:
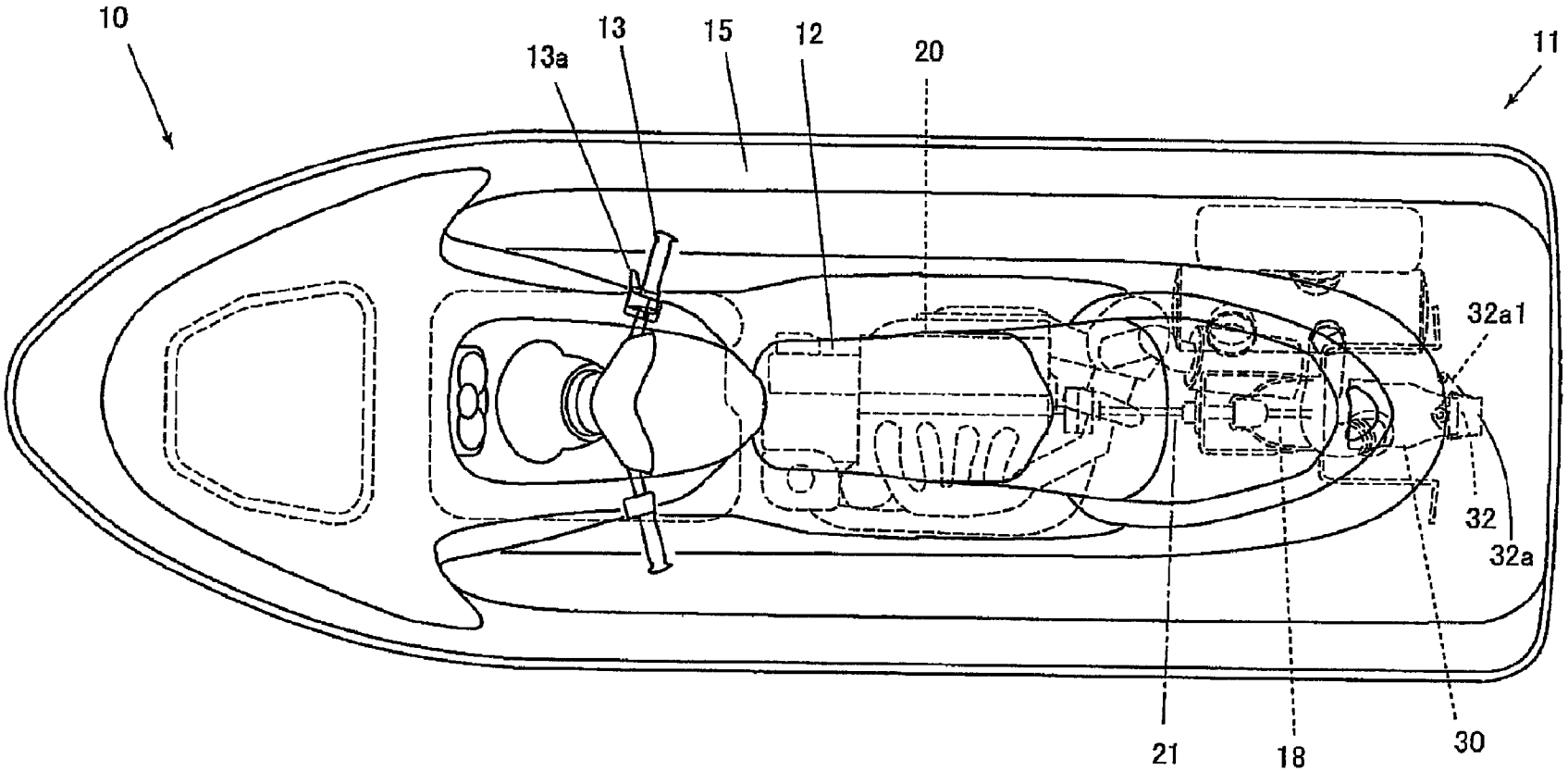
FIG. 2 is a schematic top-plan view of the personal watercraft.

FIG. 1 is a partly cut-away schematic side view of an exemplar personal watercraft that employs a water-jet pump according to an embodiment of the present invention. FIG. 2 is a schematic top-plan view of the personal watercraft.

As these drawings show (mainly FIG. 1 shows), a personal watercraft 10 is a saddle-ride type small watercraft. A rider is seated on a seat 12 disposed on top of a boat body 11. The rider is able to steer the boat by holding a steering handlebar 13 provided with a throttle lever.

The boat body 11 is formed by joining a hull 14 and a deck 15 together. A space 16 is thus formed inside the boat body 11, so that the boat body 11 has a floating-body structure. An engine 20 is installed on the hull 14, inside the space 16. A water-jet pump 30, which serves as propelling means driven by the engine 20, is disposed in the rear portion of the hull 14.

The jet pump 30 includes an impeller 40 disposed inside a flow passage 18. The flow passage 18 is formed from a water-inlet port 17 being an opening formed in the bottom of the boat, to a jet-out port 32 being an opening formed around the stern, and extending to a nozzle 32*a*. A shaft 22 to drive the impeller 40 (a drive shaft 22) is coupled to an output shaft 21 of the engine 20 via a coupler 23. When the engine 20 drives to rotate the impeller 40 via the coupler 23 and the drive shaft 22, the water that has been taken in from the water-inlet port 17 is jet out through the jet-out port 32 and the nozzle 32*a*. Thus, the boat body 11 is propelled by the water jet. The rotation of the engine 20, that is, the propulsion of the jet pump 30, is controlled by a turning operation of a throttle lever 13*a* (see FIG. 2) of the steering handlebar 13. A lever 32*a*1 is formed integrally with the nozzle 32*a* and is linked, using a linkage mechanism including an unillustrated wire and the like, to the steering handlebar 13. Thereby, the nozzle 32*a* is given a turning action by an operation of the steering handlebar 13, and the turning action of the nozzle 32*a* changes the course of the boat body 11.

Figure 3:
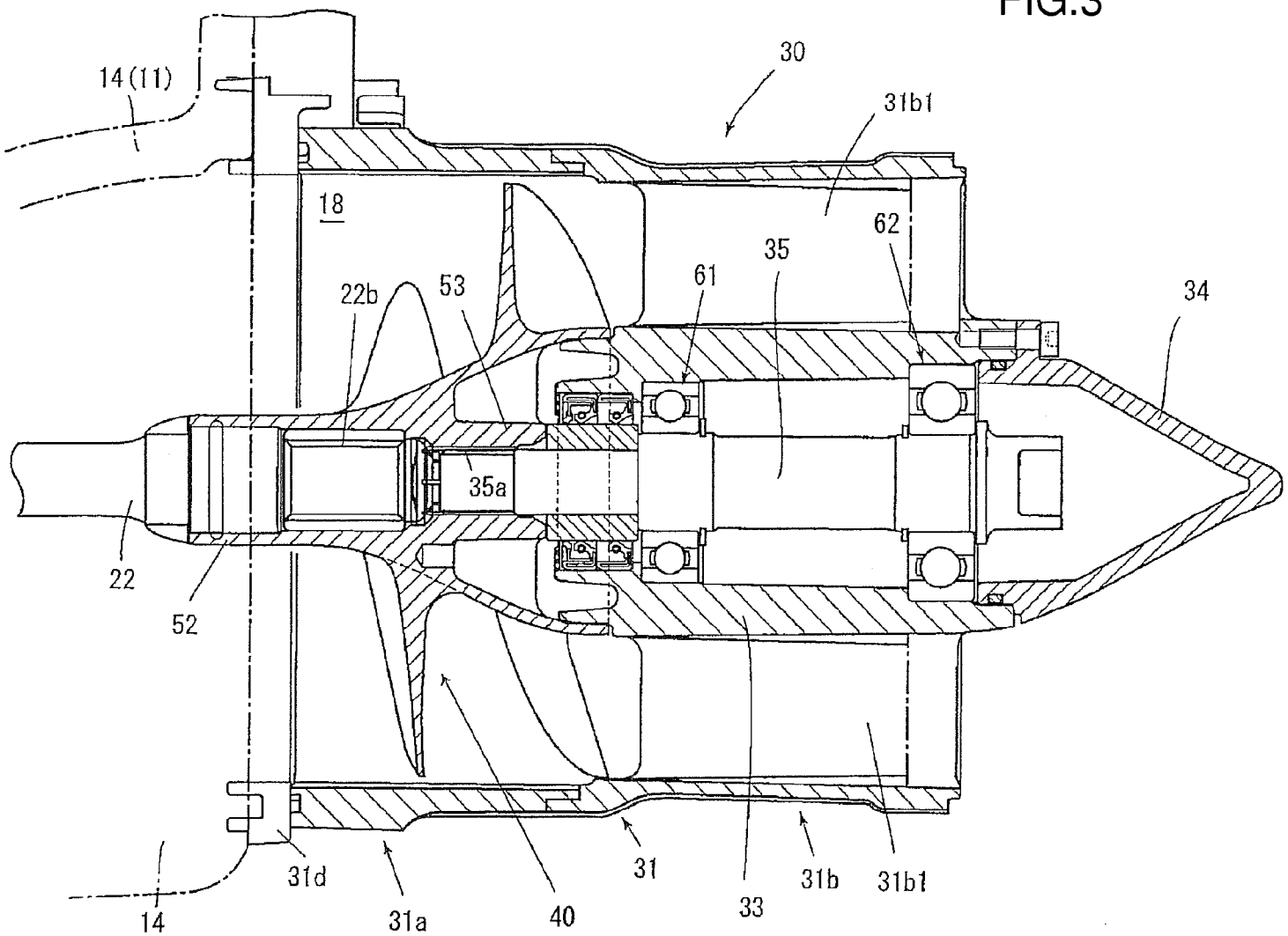
FIG. 3 is a sectional view illustrating the jet pump.

FIG. 3 is a sectional view illustrating the jet pump 30.

As FIG. 3 shows, the jet pump 30 includes: a cylindrical housing (stator duct) 31 forming the flow passage 18 which is communicatively connected to the water-inlet port 17 (see FIG. 1) formed in the bottom of the boat body 11; the impeller 40 disposed inside the housing 31; a bearing portion 33 formed inside the housing 31, and a cap 34 to close the rear end of the bearing portion 33.

The jet pump 30 is detachably attached to the hull 14 by fixing a flange portion 31*d* formed in the front portion of the housing 31 to the hull 14 by an unillustrated bolt.

The housing 31 includes an impeller-housing portion 31*a*, a bearing-housing portion 31*b*, and the jet-out port 32 (see FIG. 1). The impeller-housing portion 31*a* and the bearing-housing portion 31*b* are formed integrally with each other. Inside the bearing-housing portion 31*b*, the bearing portion 33 is formed integrally with the bearing-housing portion 31*b* with stator vanes 31*b*1 formed in between.

Figure 4:
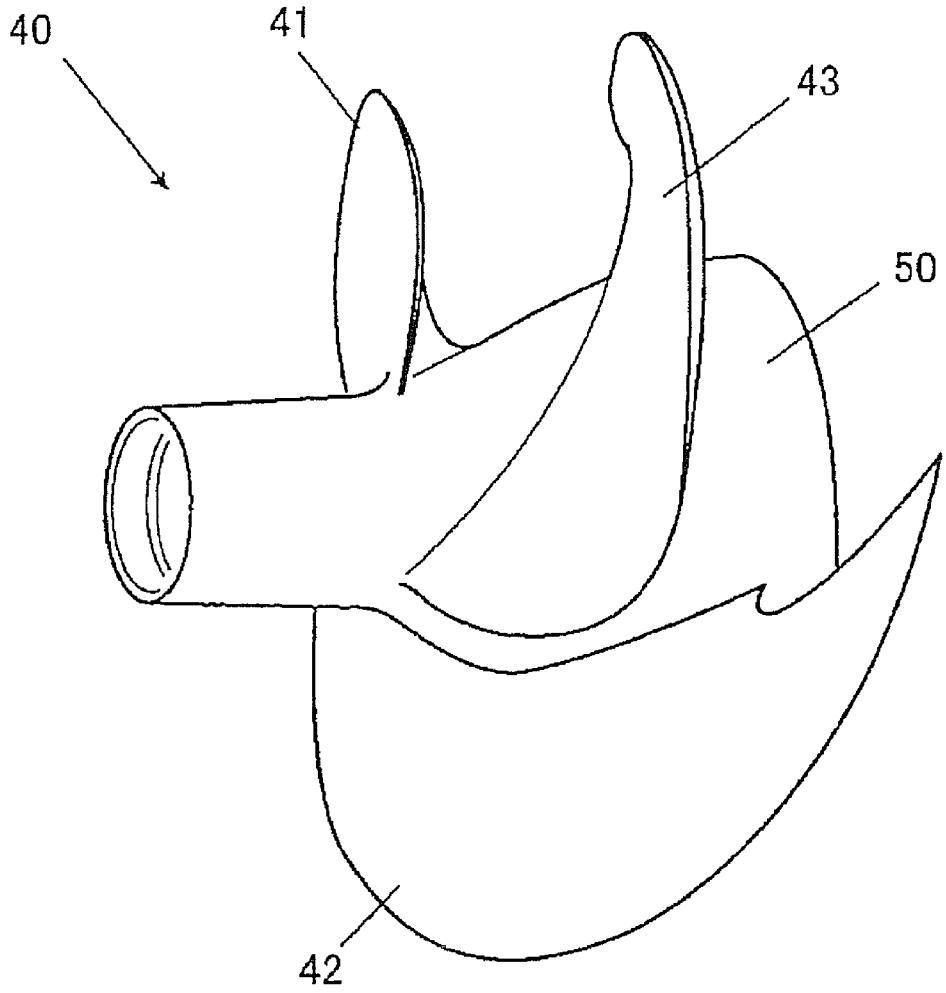
FIG. 4 is a perspective view of an impeller.
Figure 5:
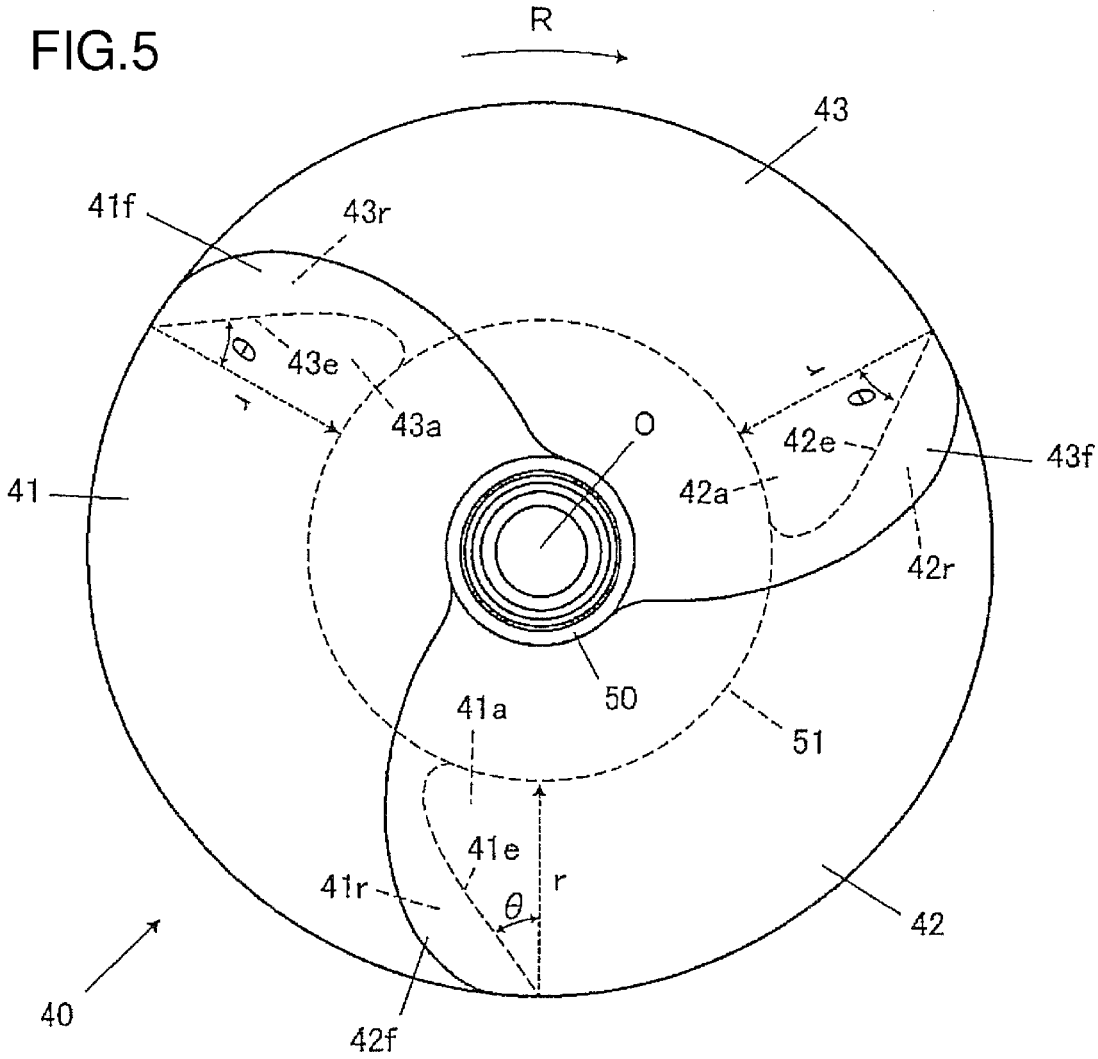
FIG. 5 is a front view of the impeller (from the left-hand side in FIG. 4)
Figure 6B:
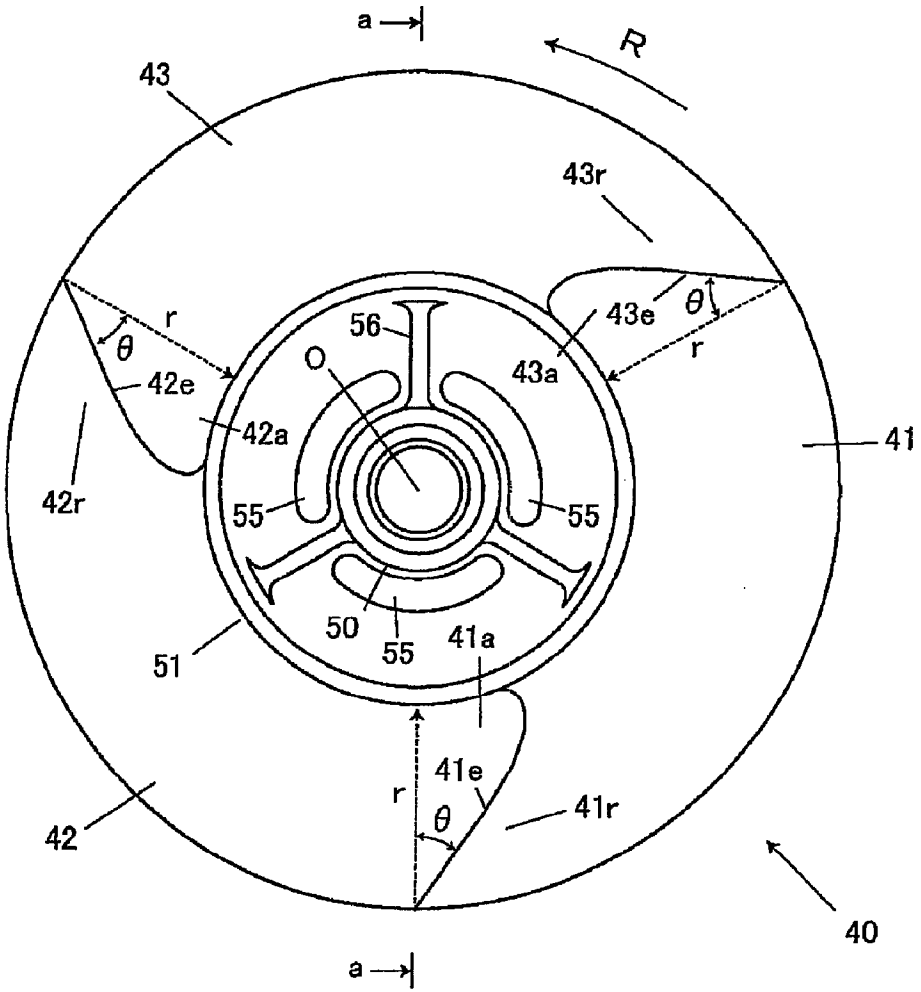
FIG. 6B is a rear view of the impeller.
Figure 6A:
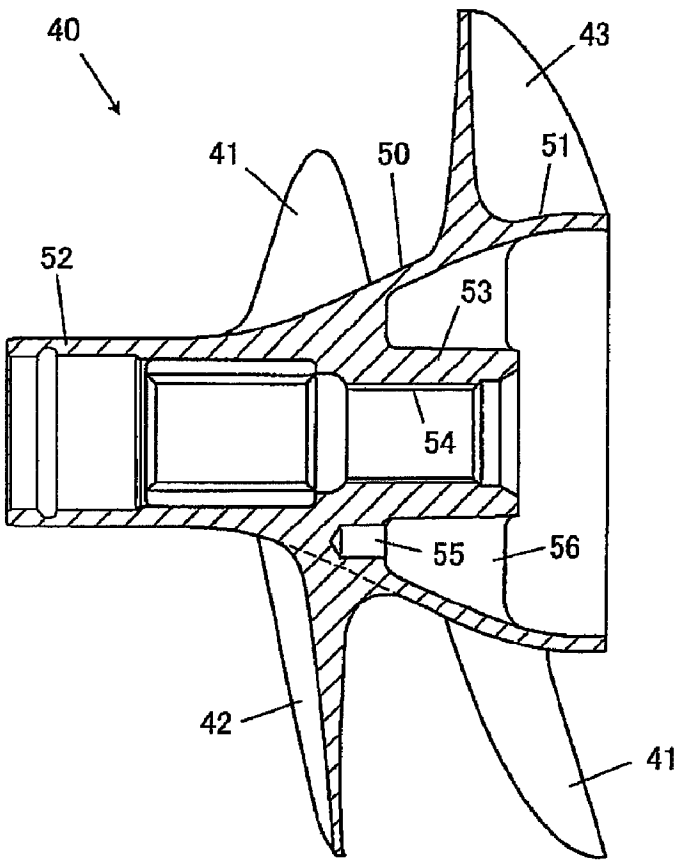
FIG. 6A is a sectional view of the impeller (a sectional view taken along the line a-a in FIG. 6B)

FIG. 4 is a perspective view of the impeller 40. FIG. 5 is a front view of the impeller 40 (seen from the left-hand side in FIG. 4). FIG. 6A is a sectional view of the impeller 40 (a sectional view taken along the line a-a in FIG. 6B). FIG. 6B is a rear view of the impeller 40.

As FIGS. 3 to 6 show, the impeller 40 includes a shaft body 50 and plural blades (specifically, three blades in the illustrated example) 41, 42, and 43 that are spirally and integrally formed on the outer circumference of the shaft body 50. The front portion of each one of the blades 41, 42, and 43 overlaps the rear portion of the adjacent one of the blades 41, 42, and 43 when viewed in the axial direction. To be more specific, when viewed in the axial direction as in the case of FIG. 5, a front portion 41*f* of the blade 41 overlaps the rear portion 43*r* of the blade 43, a front portion 42*f* of the blade 42 overlaps a rear portion 41*r* of the blade 41, and a front portion 43*f* of the blade 43 overlaps a rear portion 42*r* of the blade 42.

In each of FIGS. 5 and 6B, an arrow R indicates the direction in which the impeller 40 rotates. Each of rear edges 41*e*, 42*e*, and 43*e* of the respective blades 41, 42, and 43 is formed obliquely towards the upstream side with respect to a corresponding radial direction r to the shaft center O. A cutaway portion 41*a* of the blade 41, a cutaway portion 42*a* of the blade 42, and a cutaway portion 43*a* of the blade 43 are formed respectively between an outer circumference 51 of the shaft body 50 and the obliquely-formed portions (i.e., the rear edges 41*e*, 42*e*, and 43*e*).

With respect to the radial direction r to the shaft center O, each of the obliquely-formed portions 41*e*, 42*e*, and 43*e* has an oblique angle θ that is desirably in a range from about 10° to about 60°, inclusive. The oblique angle θ is more preferably in a range from about 20° to about 40°, inclusive. The oblique angle θ is set at approximately 35° in this embodiment.

When the oblique angle θ is smaller than 10°, the cutaway portions 41*a*, 42*a*, and 43*a* become too small to sufficiently reduce the change in the pressure in the overlap region OL. Consequently, neither the vibrations nor the annoying sounds can be reduced. By contrast, when the oblique angle θ is larger than 60°, the cutaway portions 41*a*, 42*a*, and 43*a* become so large as to impair the pumping efficiency.

Accordingly, as described above, the oblique angle θ is desirably in a range from about 10° to about 60°, inclusive, and is more preferable in a range from about 20° to about 40°, inclusive.

FIGS. 6A and 6B shows lightening-hole portions 55 each of which is formed in an arc shape when viewed from the rear side. In addition, reinforcing ribs 56 are formed between a boss portion and the inner surface of the shaft body 50.

As FIG. 3 shows, the impeller 40, in which a boss front portion 52 of the of the shaft body 50 engages with splines 22*b* formed in the rear end of the drive shaft 22, revolves together with the drive shaft 22. As mentioned above, the front-end portion of the drive shaft 22 is coupled, via the coupler 23, to the output shaft 21 of the engine 20 mounted in the boat body 11 (see FIG. 1).

On the other hand, an impeller shaft 35 that supports a rear boss portion 53 of the shaft body 50 is rotatably (capable of revolving on it axis) supported by the bearing portion 33 via shaft-bearing members 61 and 62 (ball bearings in the example shown in FIG. 3) respectively in front and rear position of the impeller shaft 35. At the front end of the impeller shaft 35, a male-threaded portion 35*a* is formed, while a female-threaded portion 54 (see FIG. 6A) is formed in the rear boss portion 53 of the shaft body 50. The male-threaded portion 35*a* and the female-threaded portion 54 are screwed together, and thereby the impeller 40 and the impeller shaft 35 are coupled together.

As has been described above, the impeller 40 has its front boss portion 52 coupled to the shaft 22, and has its rear boss portion 53 coupled to the impeller shaft 35. Accordingly, the impeller 40 revolves together with the shaft 22 and the impeller shaft 35.

Figure 7B:
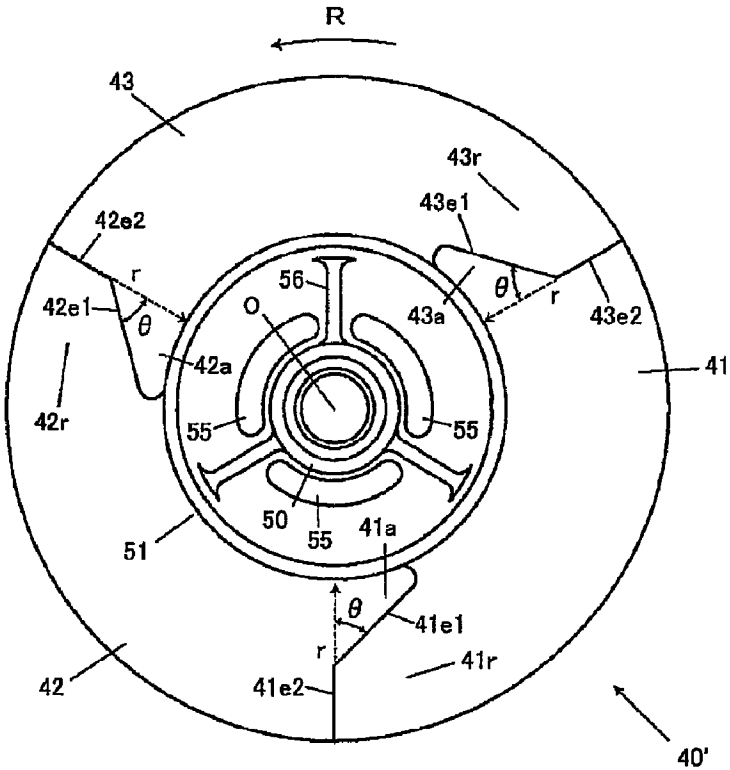
FIG. 7B is a rear view of the modified example.
Figure 7A:
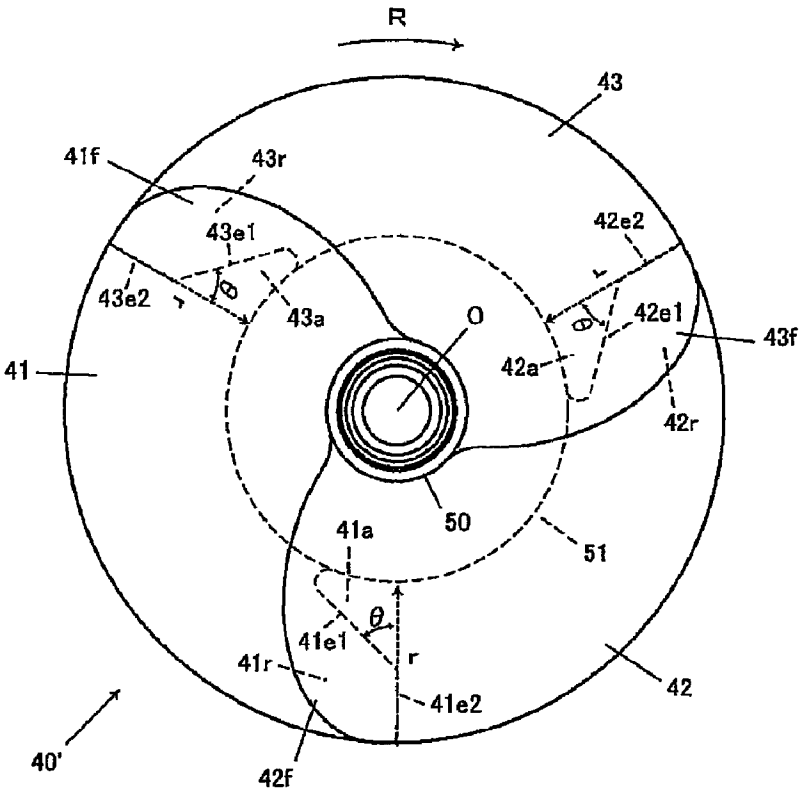
FIG. 7A is a front view of a modified example of the impeller.

FIGS. 7A and 7B are views illustrating a modified example of the impeller. FIG. 7A is a front view of the impeller, and FIG. 7B is a rear view thereof. The same reference numerals given to the parts of the impeller 40 when the parts in FIGS. 7A and 7B are identical to or correspond to the parts in FIGS. 5 and 6.

An impeller 40' differs from the above-mentioned impeller 40 only in the following point. Of the rear edges of the blades 41, 42, and 43, the parts contiguous from the shaft center O are denoted by 41*e*1, 42*e*1, and 43*e*1, respectively. Each of the parts 41*e*1, 42*e*1, and 43*e*1 is directed obliquely towards the upstream side with respect to a radial direction r to the shaft center O. Thus, a cutaway portion 41*a* of the blade 41, a cutaway portion 42*a* of the blade 42, and a cutaway portion 43*a* of the blade 43 are formed respectively between an outer circumference 51 of the shaft body 50 and the obliquely-formed portions (i.e., the parts 41*e*1, 42*e*1, and 43*e*1). The rest of the configuration of the impeller 40' is the same as that of the impeller 40.

Each of the obliquely-formed portions 41*e*1, 42*e*1, and 43*e*1 has an oblique angle θ that is set at approximately 45° with respect to the corresponding radial direction r to the shaft center O.

Each of the outer-side parts 41*e*2, 42*e*2, and 43*e*2 being other parts of the rear edges is directed in the same direction as the corresponding radial direction r towards the shaft center O.

According to the water-jet pump described above, the following advantageous effects can be obtained.

(a) When viewed in the axial direction, at least a part of each of the rear edges 41*e*, 42*e*, and 43*e* of the blades 41, 42, and 43 (each of the substantially entire parts of the rear edges 41*e*, 42*e*, and 43*e* in the case of FIG. 5, respectively; and each of the parts 41*e*1, 42*e*1, and 43*e*1 of the rear edges 41*e*, 42*e*, and 43*e* in the case of FIG. 7, respectively) is formed obliquely towards the upstream side with respect to the corresponding radial direction r to the shaft center O. Thus, the cutaway portion 41*a* of the blade 41, the cutaway portion 42*a* of the blade 42, and the cutaway portion 43*a* of the blade 43 are formed respectively between the outer circumference 51 of the shaft body 50 and their respective obliquely-formed portions. Accordingly, in the cutaway portions 41*a*, 42*a*, and 43*a*, no interference takes place between a high-pressure region of the front portions 41*f*, 42*f*, and 43*f* of the blades 41, 42, and 43 (to be more specific, a high-pressure region located at the back-surface side of the front portion of each blade) and a low-pressure region of the rear portions 43*r*, 41*r*, and 42*r* of the corresponding adjacent blades 43, 41, and 42 (to be more specific, a low pressure region located at the front-surface side of the rear portion of the corresponding blade).

For this reason, in the cutaway portions 41*a*, 42*a*, and 43*a*, the pressure fluctuation is significantly reduced, and the disturbances in the water flow are reduced as well. Accordingly the vibrations and the annoying sounds caused by the disturbances in the water flow are reduced. As a consequence, the vibrations of the boat body 11 are reduced as well.

Figure 8:
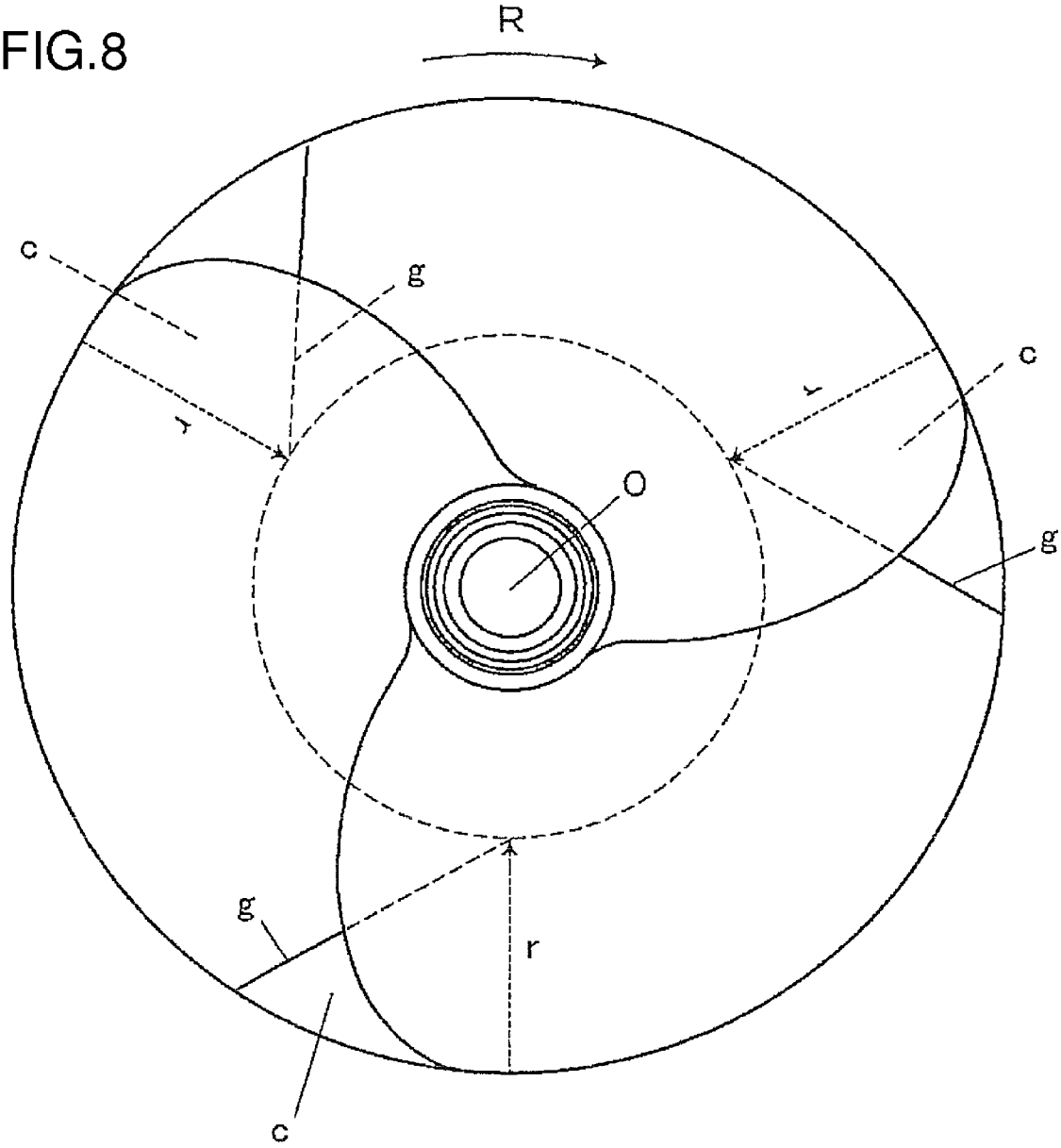
FIG. 8 is a view of a comparative example of the impeller.
Figure 9B:
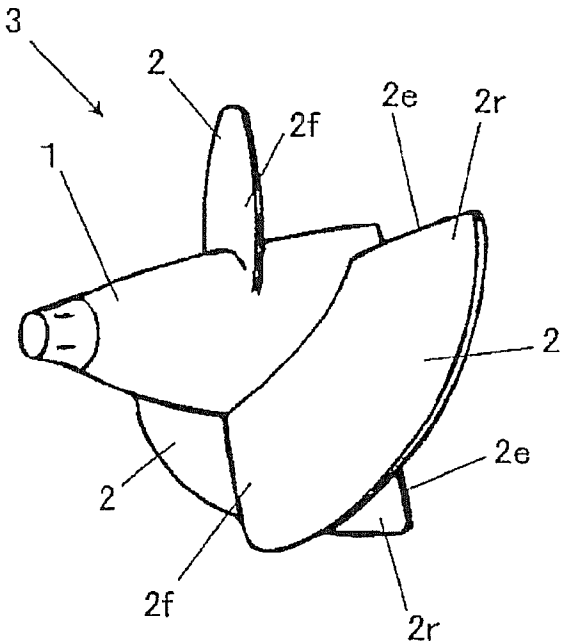
FIGS. 9A and 9B are explanatory views of a conventional art.
Figure 9A:
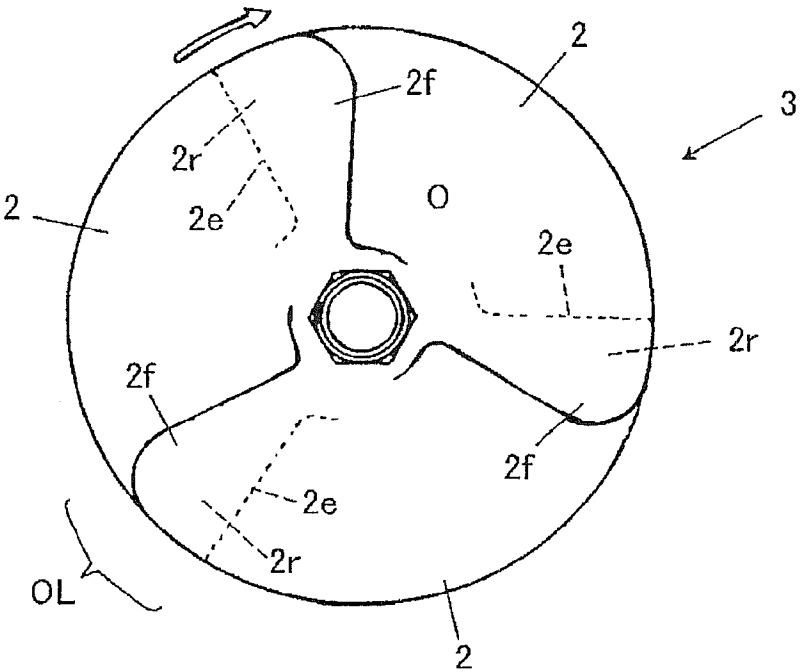
BACKGROUND ART FIG.9A

Moreover, while at least a part of a rear edge of each blade is directed obliquely toward the upstream side in the rotating direction with respect to the radial direction to the shaft center, each of the cut-away portion 41*a*, 42*a* and 43*a* is formed between each obliquely-formed portion and the outer circumference of the shaft body, in other words, in a portion closer to the center of the impeller 40. The water jet-pump with such cutaway portion has increased pumping efficiency (an achievement of higher pumping efficiency) compared to the water jet-pump, as shown in FIG. 8, with cutaway portions c which are formed respectively, by directing at least a part of a rear edge g of the blades obliquely toward the downstream side with respect to the radial direction to the shaft center, on the outer side of their obliquely-formed portions g, in other words, formed in portions on the outer side of the impeller, respectively. The blades of the comparative example shown in FIG. 8 have their respective cutaway portions formed in the outer-side portions thereof, so that the pumping efficiency is decreased.

(b) The oblique angle of each of the obliquely-formed portions is set in a range from about 10° to about 60°, inclusive with respect to the corresponding radial direction r to the shaft center O. This setting of the oblique angle guarantees the achieving of the above-described advantageous effects.

In the water-jet pump according to the embodiment of the present invention, an impeller is disposed in a cylindrical housing and is driven to rotate. The impeller includes a shaft body and plural blades formed on the outer circumference of the shaft body. A front portion of each one of the blades overlaps a rear portion of the adjacent one of the blades when viewed in the axial direction of the impeller. In addition, when viewed in the axial direction of the impeller, at least a part of a rear edge of each of the blades is formed obliquely, with respect to a radial direction to a shaft center, towards the upstream side in the rotating direction of the impeller. In addition, a cutaway portion of the blade is formed between each of the obliquely-formed portions and the outer circumference of the shaft body. With this configuration, the following advantageous effects are obtained.

Specifically, in the water-jet pump, when viewed in the axial direction of the impeller, at least a part of a rear edge of each of the blades is formed obliquely, with respect to a radial direction to a shaft center, towards the upstream side in the rotating direction of the impeller. In addition, a cutaway portion of the blade is formed between each of the obliquely-formed portions and the outer circumference of the shaft body. For these reasons, no interference between a high-pressure region in the front portion of each one of the blades and a low-pressure region of the rear portion of the adjacent one of the blades takes place in the corresponding one of the cutaway portions.

Accordingly, in the cutaway portions, the pressure fluctuation is significantly reduced, and the disturbances of the water flow are reduced as well. For these reasons, vibrations and annoying sounds that are caused by the disturbances of the water flow are reduced as well. As a consequence, the vibrations of the boat body are reduced as well.

As described above, according to the embodiment of the present invention, the pressure fluctuation in the overlap region can be reduced. Accordingly, the vibrations and the annoying sounds can be reduced as well.

Besides, the cutaway portions are formed between the outer circumference of the shaft body and their respective obliquely-formed portions each of which is formed by directing at least a part of a rear edge of the blade obliquely towards the upstream side with respect to the corresponding radial direction to the shaft center. The cutaway portions are thus formed in portions located closer to the center of the impeller. The above-described water-jet pump is compared with a second water-jet pump with the following configuration. The second water-jet pump has an impeller which with at least a part of the rear edge of each of its blades formed obliquely towards the downstream side with respect to the corresponding radial direction to the shaft center. In addition, in the impeller of the second water-jet pump, the cutaway portions are formed on the outer side of their respective obliquely-formed portions, that is, on the outer side of the impeller. The comparison reveals an improvement in the pumping efficiency (an achievement of higher pumping efficiency) that is obtained by use of the water-jet pump according to the embodiment of the present invention.

Moreover, while at least a part of a rear edge of each blade is directed obliquely toward the upstream side in the rotating direction with respect to the radial direction to the shaft center, the cut-away portion is formed between each obliquely-formed portion and the outer circumference of the shaft body, in other words, in a portion closer to the center of the impeller. The water jet-pump with such cutaway portion has increased pumping efficiency (an achievement of higher pumping efficiency) compared to the water jet-pump in which, by directing at least a part of a rear edge of each blade obliquely toward the downstream side in the rotating direction with respect to the radial direction to the shaft center, a cut-away portion is formed on the outer side of the obliquely-formed portion, that is, in a portion on the outer side of the impeller.

In addition, the oblique angle of each of the obliquely-formed portions is set in a range from about 10° to about 60°, inclusive, with respect to the corresponding radial direction. This setting of the oblique angle guarantees the achieving of the above-described advantageous effects.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. A water-jet pump comprising:

a cylindrical housing; and an impeller disposed in the cylindrical housing and configured to be rotated in a rotating direction, the impeller comprising:

a shaft body having an outer circumference and an axial direction; and plural blades provided on the outer circumference of the shaft body and each of the plural blades having a front portion and a rear portion along the axial direction, the front portion of one of the plural blades overlapping the rear portion of another of the plural blades adjacent to said one of the plural blades when viewed in the axial direction, wherein, when viewed in the axial direction, at least a part of a rear edge of the rear portion is formed obliquely with respect to a radial direction of the impeller towards the rotating direction, and wherein a cutaway portion is formed in each of the plural blades between said at least a part of the rear edge and the outer circumference of the shaft body.

2. The water-jet pump according to claim 1, wherein said at least a part of the rear edge has an oblique angle of at least about 10° and at most about 60° with respect to the radial direction.

3. The water-jet pump according to claim 2, wherein said at least a part of the rear edge has an oblique angle of at least about 20° and at most about 40° with respect to the radial direction.

4. An impeller for a water-jet pump configured to be rotated in a rotating direction, the impeller comprising:

a shaft body having an outer circumference and an axial direction; and plural blades provided on the outer circumference of the shaft body and each of the plural blades having a front portion and a rear portion along the axial direction, the front portion of one of the plural blades overlapping the rear portion of another of the plural blades adjacent to said one of the plural blades when viewed in the axial direction, wherein, when viewed in the axial direction, at least a part of a rear edge of the rear portion is formed obliquely with respect to a radial direction of the impeller towards the rotating direction, and wherein a cutaway portion is formed in each of the plural blades between said at least a part of the rear edge and the outer circumference of the shaft body.

5. A boat comprising:

water-jet pump comprising:

a cylindrical housing; and an impeller disposed in the cylindrical housing and configured to be rotated in a rotating direction, the impeller comprising:

a shaft body having an outer circumference and an axial direction; and plural blades provided on the outer circumference of the shaft body and each of the plural blades having a front portion and a rear portion along the axial direction, the front portion of one of the plural blades overlapping the rear portion of another of the plural blades adjacent to said one of the plural blades when viewed in the axial direction, wherein, when viewed in the axial direction, at least a part of a rear edge of the rear portion is formed obliquely with respect to a radial direction of the impeller towards the rotating direction, and wherein a cutaway portion is formed in each of the plural blades between said at least a part of the rear edge and the outer circumference of the shaft body.

6. The water-jet pump according to claim 1, wherein another part of the rear edge of the rear portion extends along the radial direction of the impeller.

7. The water-jet pump according to claim 6, wherein said at least a part of the rear edge has an oblique angle of about 45° with respect to the radial direction.

8. The water-jet pump according to claim 6, wherein the another part of the rear edge extends from an outer circumference of the rear portion of the another of the plural blades to a location about half way to the outer circumference of the shaft body, and wherein said at least a part of the rear edge extends from the another part of the rear edge.

9. The water-jet pump according to claim 1, wherein the front portion of said one of the plural blades overlaps an entirety of the rear edge of said another of the plural blades adjacent to said one of the plural blades when viewed in the axial direction.

10. The impeller according to claim 4, wherein said at least a part of the rear edge has an oblique angle of at least about 10° and at most about 60° with respect to the radial direction.

11. The impeller according to claim 10, wherein said at least a part of the rear edge has an oblique angle of at least about 20° and at most about 40° with respect to the radial direction.

12. The impeller according to claim 4, wherein another part of the rear edge of the rear portion extends along the radial direction of the impeller.

13. The impeller according to claim 12, wherein said at least a part of the rear edge has an oblique angle of about 45° with respect to the radial direction.

14. The impeller according to claim 12, wherein the another part of the rear edge extends from an outer circumference of the rear portion of the another of the plural blades to a location about half way to the outer circumference of the shaft body, and wherein said at least a part of the rear edge extends from the another part of the rear edge.

15. The impeller according to claim 4, wherein the front portion of said one of the plural blades overlaps an entirety of the rear edge of said another of the plural blades adjacent to said one of the plural blades when viewed in the axial direction.

16. The boat according to claim 5, wherein said at least a part of the rear edge has an oblique angle of at least about 10° and at most about 60° with respect to the radial direction.

17. The boat according to claim 16, wherein said at least a part of the rear edge has an oblique angle of at least about 20° and at most about 40° with respect to the radial direction.

18. The boat according to claim 5, wherein another part of the rear edge of the rear portion extends along the radial direction of the impeller.

19. The boat according to claim 18, wherein the another part of the rear edge extends from an outer circumference of the rear portion of the another of the plural blades to a location about half way to the outer circumference of the shaft body, and wherein said at least a part of the rear edge extends from the another part of the rear edge.

20. The boat according to claim 15, wherein the front portion of said one of the plural blades overlaps an entirety of the rear edge of said another of the plural blades adjacent to said one of the plural blades when viewed in the axial direction.

* * * * *